US012788146B2

(12) United States Patent
Yang

(10) Patent No.: US 12,788,146 B2
(45) Date of Patent: Nov. 10, 2026

(54) FOLDING ROCKING CHAIR

(71) Applicant: Zhejiang Hengfeng Top Leisure Co., Ltd., Zhejiang Province (CN)

(72) Inventor: Baoqing Yang, Wukang Town (CN)

(73) Assignee: Zhejiang Hengfeng Top Leisure Co., Ltd., Zhejiang Province (CN)

( * ) Notice: Subject to any disclaimer, the term of this patent is extended or adjusted under 35 U.S.C. 154(b) by 90 days.

(21) Appl. No.: 18/955,029

(22) Filed: Nov. 21, 2024

(65) Prior Publication Data

US 2025/0169608 A1 May 29, 2025

(30) Foreign Application Priority Data

Nov. 27, 2023 (CN) ..... 202323216947.X

(51) Int. Cl.
*A47C 3/025* (2006.01)
*A47C 4/28* (2006.01)

(52) U.S. Cl.
CPC ..... *A47C 4/286* (2013.01); *A47C 3/0255* (2013.01)

(58) Field of Classification Search
CPC ..... A47C 4/286; A47C 3/0255; A47C 3/0252; A47C 3/0257
See application file for complete search history.

(56) References Cited

U.S. PATENT DOCUMENTS 3,114,572 A * 12/1963 Hopkins ..... A47C 3/029 297/133
5,992,929 A * 11/1999 Liu ..... A47C 4/10 297/272.1
9,060,611 B2 6/2015 Grace
9,282,824 B2 3/2016 Grace
10,874,217 B2 12/2020 Grace
11,534,000 B2 * 12/2022 Cook ..... A47C 7/002
(Continued)

FOREIGN PATENT DOCUMENTS

CN 209825885 U 12/2019
CN 211795403 U * 10/2020 ..... A47C 4/286
(Continued)

OTHER PUBLICATIONS

English translation for CN-216702061-U (Year: 2022).*
English translation for CN-114403629-A (Year: 2022).*
English translation for CN-211795403-U (Year: 2020).*

*Primary Examiner* — David R Dunn
*Assistant Examiner* — Troy Alan Libby
(74) *Attorney, Agent, or Firm* — Thompson Coburn LLP

(57) ABSTRACT

A folding rocking chair includes a foldable frame structure that is movable between folded and unfolded states. The frame structure has a seat body and two bases. The seat body includes two side frames and a connection portion connecting the side frames. A base is connected to each side frame. Each side frame includes a reclining surface forming rod and a front support rod, each having a base end and an opposite upper end. The upper end of the front support rod is operatively hingedly connected to the reclining surface forming rod. One of the base end of the front support rod and the base end of the reclining surface forming rod is swingingly pivotally connected to the respective base and the other of the base end of the front support rod and the base end of the reclining surface forming rod is operatively rotably connected to the respective base.

17 Claims, 7 Drawing Sheets

(56) References Cited

U.S. PATENT DOCUMENTS

| | | | | |
|---|---|---|---|---|
| 2014/0097647 | A1* | 4/2014 | Grace | A47C 3/0255<br>297/42 |
| 2019/0110599 | A1* | 4/2019 | Grace | A47C 4/286 |
| 2020/0305606 | A1* | 10/2020 | Chen | A47C 4/286 |
| 2022/0218109 | A1* | 7/2022 | Sun | A47C 4/283 |
| 2023/0036948 | A1* | 2/2023 | Choi | A47C 3/02 |

FOREIGN PATENT DOCUMENTS

| | | | | |
|---|---|---|---|---|
| CN | 114403629 A | * | 4/2022 | A47C 4/00 |
| CN | 216702061 U | * | 6/2022 | |

* cited by examiner

FOLDING ROCKING CHAIR

RELATED APPLICATION DATA

This application claims priority benefit to Chinese utility model patent application No. 202323216947.X, filed Nov. 27, 2023, the disclosure of which is incorporated by reference herein.

TECHNICAL FIELD

The present disclosure relates to the technical field of outdoor and indoor furniture, and specifically relates to a folding rocking chair frame and a folding rocking chair.

BACKGROUND ART

The folding rocking chair is popular due to its functional effect of easy storage. The disclosure is directed to a folding rocking chair, which significantly improves the experience in use, such as those in the prior art, including a chair as disclosed in CN 216702061U.

By way of example, the chair as disclosed in CN 216702061U and others in the prior art have disadvantages in folding for storage. In order to be folded for storage, the chair as disclosed in CN 216702061U, the lower end of the backrest tube used to form the mounting location of the backrest is connected to the base by sliding. The sliding member for realizing the slidable connection has a relatively large stroke, which causes interference with the mounting position of the elastic assembly that is used for rocking for the seat, which in turn leads to the problem of insufficient rocking as the elastic assembly is positioned too far forward on the base.

SUMMARY

The present disclosure is intended to solve one of the technical problems of such conventional rocking chairs. Therefore, the present disclosure provides a folding rocking chair and frame, which not only facilitates storage, but also provides a more optimum mounting position of the elastic assembly for an improved level of rocking.

In order to realize the above object, the present disclosure adopts the following technical solutions.

A folding rocking chair includes a seat body and two bases. The seat body includes two side frames and a connection portion connecting the two side frames. Each of the side frames includes a reclining surface forming rod and a front support rod. One of one end of the front support rod is hinged to the reclining surface forming rod. In one embodiment, a bottom end of the front support rod is operatively pivotally connected to the base and a bottom end part of the reclining surface forming rod is swingingly, operatively pivotally connected to the base. In another embodiment, a bottom end of the front support rod is swingingly, operatively pivotally connected to the base and a bottom end part of the reclining surface forming rod is operatively pivotally connected to the base. In each embodiment, the folding rocking chair frame has a folded state and an unfolded state.

When the folding rocking chair frame is in the unfolded state, the connection portion separates and spaces apart the two side frames. The two bases and corresponding side frames are spaced apparat to define a mounting space of a seat surface between two side frames. The seat body can swing on the bases or rock relative to the bases front to back relative to the orientation of the seat body.

When the folding rocking chair frame is in the folded state, the connection portion is moved such that a distance between the two side frames is reduced and smaller than a distance between two side frames when the folding rocking chair frame is in the unfolded state. Also, a distance between a point on the base where the reclining surface forming rod meets the base and a joint of the front support rod to the base is smaller than a distance between them when the folding rocking chair frame is in the unfolded state.

Optionally, depending upon the embodiment, a flipping support strip may be used to form the swingingly, operatively pivotal connection with to the base. Thus, in one embodiment, a bottom end of the front support rod is operatively pivotally connected to the base and a bottom end part of the reclining surface forming rod includes the flipping support strip to swingingly, operatively pivotally connect the reclining surface forming rod to the base. In another embodiment, a bottom end of the front support rod includes the flipping support strip to swingingly, operatively pivotal connect the front support rod to the base. One end of the flipping support strip is rotationally connected to one end of the reclining surface forming rod or an end part of the front support rod, and the other end of flipping support strip is rotationally connected to the base.

In the technical solutions provided by the present disclosure, the reclining surface forming rod and the base are movably connected by the flipping support strip. When the folding rocking chair frame is unfolded, the reclining surface forming rod can abut against the base without sliding, which ensures the stability of the folding rocking chair frame. When the folding rocking chair is folded, the flipping support strip creates necessary clearance between the base and the reclining surface forming rod to allow the base and the reclining surface forming rod to pivot adjacent one another as necessary. In the prior art, the stroke of sliding motion needed for the connection of the bottom of backrest with the base during folding limits the available location of the elastic assembly along the base. In the disclosed embodiment, the movement of the flipping support strip relative to the reclining surface forming rod and the base increases the adjustable range of positions of the elastic assembly, and the amount of rocking of the folding rocking chair frame may also be increased. Further, in the unfolded configuration, the flipping support strip connection with the reclining surface forming rod and the reclining surface forming rod abutment with the base provides more stability in comparison to the prior chair having the sliding connection of the bottom of backrest with the base.

Optionally, the base includes a base upper rod and a base lower rod, and the base upper rod and the base lower rod are connected by an elastic assembly. One of the reclining surface forming rod or the front support rod is hinged to the base upper rod, and the other is movably connected to the base upper rod by the flipping support strip.

Optionally, the elastic assembly includes an upper connection member, an elastic plate, and a lower connection member. The upper connection member and the lower connection member are separately fixed to two ends of the elastic plate. The lower connection member is preferably sleeved on the base lower rod. The upper connection member is preferably sleeved on the base upper rod.

Because of the joint between the base and the flipping support strip, the range of available adjustable positions of the elastic assembly in the length direction of the base is increased, so that the swinging range of the folding rocking chair frame can be adjusted by adjusting the position of the elastic assembly in the length direction of the base. Moreover, the upper connection member in the elastic assembly is sleeved on the base upper rod, and the lower connection member is sleeved on the base lower rod, so that not only the elastic assembly will not slide out of the base, but also it facilitates the position adjustment of the elastic assembly in the length direction of the base.

Optionally, the elastic assembly includes an elastic folding plate, and the elastic folding plate includes an upper mounting part, a connection portion, and a lower mounting part, wherein the upper mounting part is fixedly connected to the base upper rod; the lower mounting part is fixedly connected to the base lower rod; and the connection potion connects the upper mounting part and the lower mounting part.

Optionally, the elastic assembly is in a shape of C or Z.

Optionally, the base further includes an anti-trap foot pad. The anti-trap foot pad includes a mounting part and side plates. The mounting part is mounted on the base lower rod; two side portions are separately arranged on two sides of the mounting part. The base upper rod may be inserted between the two side portions.

Optionally, the anti-trap foot pad is arranged on one end of the base, or each of the ends of the base are both provided with anti-trap foot pads.

The anti-trap foot pads can prevent foreign objects from entering between the base upper rod and base lower rod, which results in poor swinging.

Optionally, the bottom end of the reclining surface forming rod or the bottom end of the front support rod is hinged to the base by a hinge base. The hinge base includes a mounting part and hinged side portions. The mounting part is mounted to the base and the two hinged side portions are separately arranged and project outward from the mounting part. Depending upon the embodiment, either the reclining surface forming rod or the front support rod is rotationally connected to the hinged side plates between two hinged side portions.

Optionally, the side frame includes a support surface forming rod. One end of the support surface forming rod is slidably connected to the reclining surface forming rod. The support surface forming rod may be rotationally connected to the front support rod. When the folding rocking chair frame is in the unfolded state, a mounting space of the support surface of the seat body is formed between two support surface forming rods.

Optionally, the connection portion includes a set of first cross-connecting rods. Lower ends of the set of first cross-connecting rods are rotationally connected to the hinge bases respectively, and upper ends of the set of first cross-connecting rods are rotationally connected to the support surface forming rod respectively.

Optionally, the connection portion further includes a set of second cross-connecting rods. Ends of the set of the second cross-connecting rods are rotationally connected to joints between the reclining surface forming rods and the support surface forming rods at two sides of the seat body respectively, and the opposite ends are rotationally connected to the reclining surface forming rods.

Preferably, first and second cross-connecting rods are provided to provide more stability for the frame when the folding rocking chair frame is in the unfolded state. That said, only one rod may be provided as the first and second cross-connecting rod and/or only one set of first and second cross-connecting rods may be provided.

Optionally, the side frame includes an armrest member and an armrest member support rod. The armrest member may be provided with a connection portion, and the connection potion may be provided with a sliding groove. The armrest member support rod may be rotationally connected to the armrest member by the sliding groove. The other end of the armrest member support rod may be slidably connected to the front support rod.

Optionally, the side frame includes a linkage support strip. One end of the linkage support strip may be rotationally connected to a joint of the support surface forming rod and the reclining surface forming rod. The other end of the linkage support strip may be rotationally connected to an end of the armrest member.

Optionally, the support surface forming rod may be rotationally connected to the armrest member support rod and may be rotationally connected to both the armrest member support rod and the front support rod.

The present disclosure further discloses a folding rocking chair including a flexible seat surface assembled with the folding rocking chair frame as described above. When the folding rocking chair frame is unfolded, a mounting space of the seat surface is defined by the two side frames, and the flexible seat surface is arranged in the mounting space to form the folding rocking chair.

These features and advantages of the present disclosure will be disclosed in detail in the following specific embodiments and drawings. The preferred embodiments or methods of the present disclosure will be shown in detail in conjunction with the drawings but are not to be deemed limitations of the technical solutions of the present disclosure. Additionally, certain the features, components, and assemblies shown in the following context and drawings may include multiple like features, components, and assemblies. Some are marked with numerals for convenience, but all represent components with the same or similar construction or function.

BRIEF DESCRIPTION OF DRAWINGS

The present disclosure is further described below in conjunction with drawings.

Figure 1:
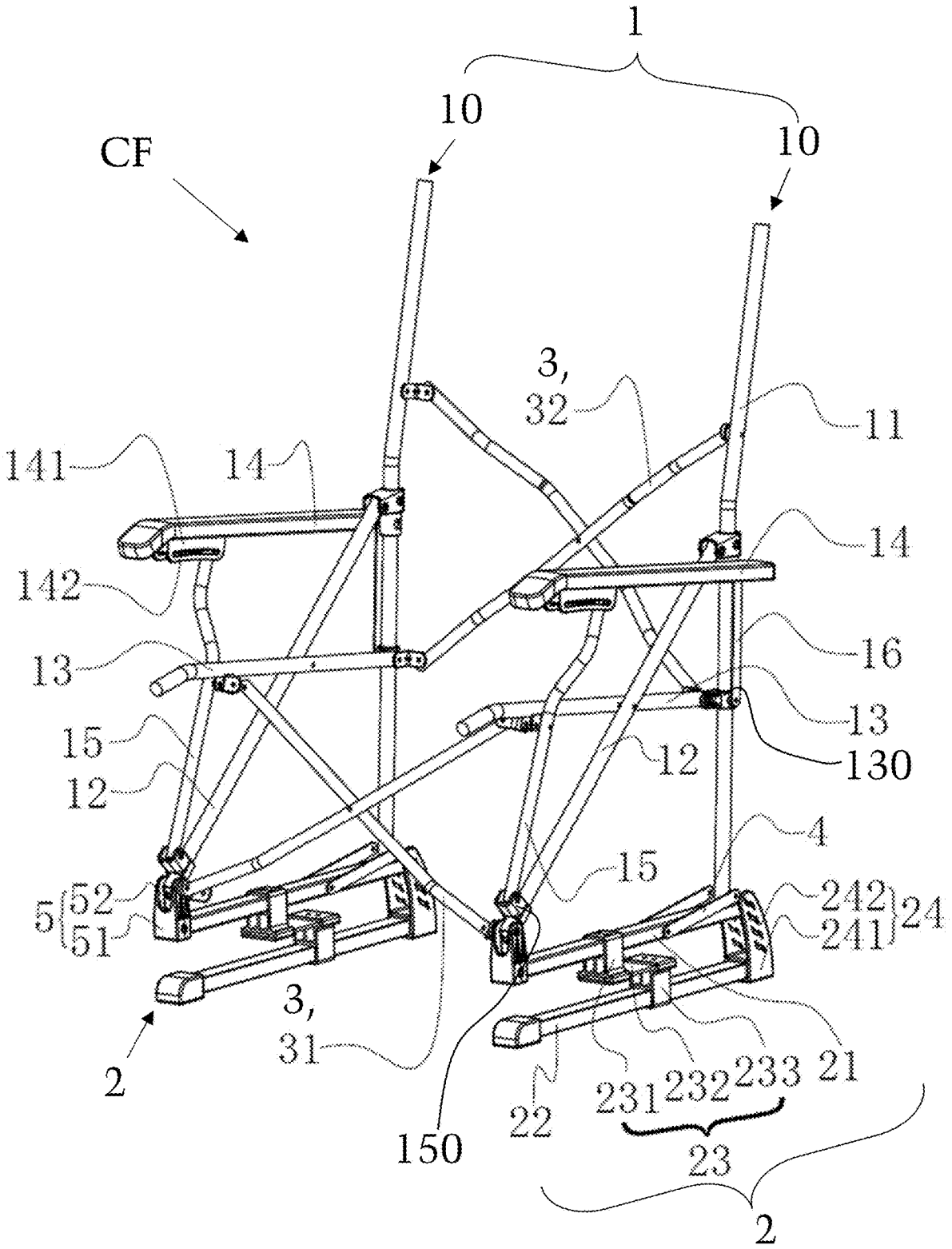
FIG. 1 is a perspective view of a folding rocking chair frame in one embodiment of the present disclosure in an unfolded state.

Reference numbers: CF and CF1—chair frame, 1—seat body, 10—side frame, 11—reclining surface forming rod, 12—front support rod, 13—support surface forming rod, 130—rear slide connection member, 14—armrest member, 141—armrest member connection part, 142—sliding groove of the armrest member, 15—support rod of the armrest member, 150—front slide connection member, 16—linkage support strip, 2—base, 21—base upper rod, 22—base lower rod, 23—elastic assembly, 231—upper connection member, 232—elastic plate, 233—lower connection member, 24—anti-trap foot pad, 241—foot mounting part, 242—side plate, 25—elastic folding plate, 251—upper mounting part, 252—connection part, 253—lower mounting part, 31—first cross-connecting rod, 32—second cross-connecting rod, 4—flipping support strip, 5—hinge base, 51—mounting part portion, 52—hinged side plate, and 6—flexible seat surface.

DETAILED DESCRIPTION OF EMBODIMENTS

The embodiments of the present disclosure are described in detail below, and the examples of the embodiments are shown in the drawings, wherein the same or similar symbols throughout denote the same or similar components or components with the same or similar function. The examples in the embodiments are intended to illustrate the present disclosure and are not to be understood as limitations of the present disclosure.

References in the specification to "an embodiment", "example" or "examples" mean that a particular feature, structure, or characteristic described in conjunction with the embodiment itself may be included in at least one embodiment disclosed by the present disclosure. The phrase "in one embodiment" does not necessarily refer to the same embodiment and may refer to all possible embodiments capable of encompassing the same feature or its equivalent.

Embodiment 1

Figure 2:
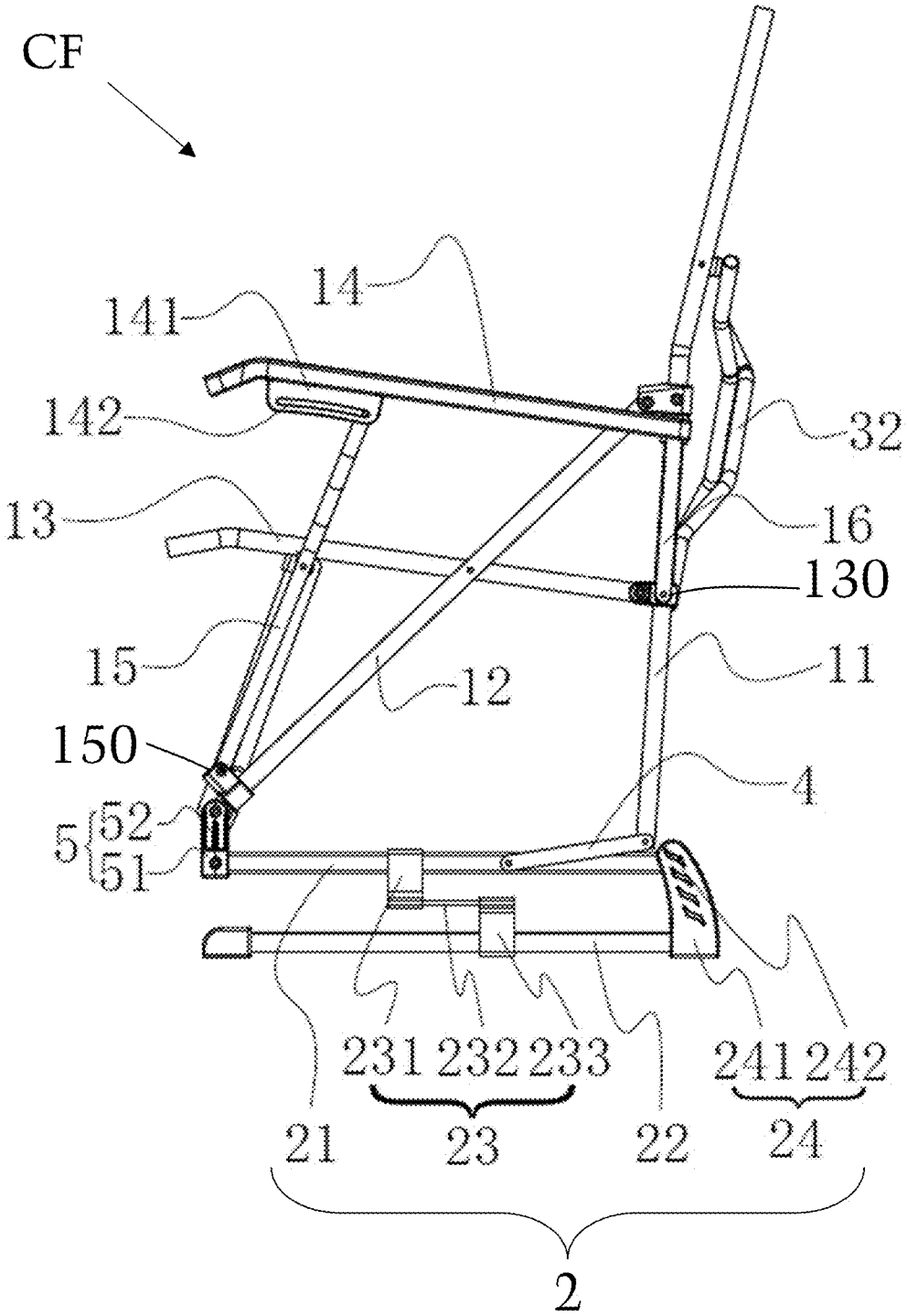
FIG. 2 is a side view of the folding rocking chair frame of FIG. 1.

As shown in FIG. 1 and FIG. 2, the embodiment provides a folding rocking chair frame (CF) including a seat body 1 and two bases 2. The seat body 1 includes two side frames 10 and a connection portion 3 connecting two side frames.

Each side frame 10 includes a reclining surface forming rod 11, a front support rod 12, a support surface forming rod 13, an armrest member 14, an armrest member support rod 15, and a linkage support strip 16. It should be noted that all rod members involved in the embodiment include, but are not limited to solid members, hollow members, rod members with circular or elliptical sections, or rod members with triangular, rectangular, or polygonal sections.

On each side frame 10, one end of the front support rod 12 is hinged to the reclining surface forming rod 11, and one end of the support surface forming rod 13 is slidably connected to the reclining surface forming rod 11 by a rear slide connection member 130. The connection position of the front support rod 12 to the reclining surface forming rod 11 is higher than the connection position of the support surface forming rod 13 to the reclining surface forming rod 11. One end of the linkage support strip 16 is rotationally connected to the rear slide connection member 130 of the support surface forming rod 13, and the other end of the linkage support strip 16 is rotationally connected to one end of the armrest member 14 and the other end of the armrest member 14 is rotationally connected to the armrest member support rod 15. The armrest member 14 is provided with a connection part 141 having sliding grooves 142 arranged on two sides of the connection part 141. The armrest member support rod 15 is rotationally connected to the armrest member 14 by the sliding grooves 142 of the connection part 141. The armrest member support rod 15 is slidably connected to the front support rod 12 by a front slide sliding connection member 150. The support surface forming rod 13 is rotationally connected to both the armrest member support rod 15 and the front support rod 12.

The base 2 includes a base upper rod 21, a base lower rod 22, an elastic assembly 23, and an anti-trap foot pad 24. The elastic assembly 23 includes an upper connection member 231, an elastic plate 232, and a lower connection member 233. The upper connection member 231 is sleeved onto the base upper rod 21 and fixed to one end of the elastic plate 232. The lower connection member 233 is sleeved onto the base lower rod 22 and fixed to the other end of the elastic plate 232. The elastic plate 232 is preferably an elastic steel plate. Other elastic materials may also be used. It is noted that the upper connection member 231 and the lower connection member 233 are sleeved on the base upper rod 21 and the base lower rod 22 to allow adjustment of the elastic assembly 23 relative to the base upper rod 21 and base lower rod 22. The sleeve connection may include but is not limited to the method of a full enclosure, half enclosure, or partial enclosure of the base upper rod 21 and/or the base lower rod 22 where the sleeve connection is sufficient to ensure that the base upper rod 21 and/or the base lower rod 22 will not be separated from the upper and lower connection members. When the half enclosure or partial enclosure is adopted, the screws can be used for reinforcement.

The anti-trap foot pad 24 includes a foot mounting part 241 and side plates 242. The foot mounting part 241 is mounted on the base lower rod 22 and the two side portions 242 are arranged on opposite sides of the foot mounting part 241 with a space therebetween. The base upper rod 21 may be interposed in the space between the two side portions 242. The anti-trap foot pad 24 can be arranged on one end of the base 2 or arranged on both ends of the base 2. The anti-trap foot pad 24 can prevent foreign objects from entering between the base upper rod 21 and base lower rod 22, which results in poor swinging.

The end part of the front support rod 12 is hinged to the base upper rod 21 of the base 2. Specifically, the front support rod 12 is hinged to the base 2 by the hinge base 5. The hinge base 5 includes a mounting portion 51 and hinge side portions 52. The mounting portion 51 is mounted to the base upper rod 21 of the base 2, and the two hinged side portions 52 project upward from the mounting portion 51, so as to form the U shape. The front support rod 12 is rotationally connected to two hinge side portions 52 between the two hinge side portions 52.

A bottom end part of the reclining surface forming rod 11 is movably connected to the base upper rod 21 of the base 2 by a flipping support strip 4. One end of the flipping support strip 4 is rotationally connected to the bottom end of the reclining surface forming rod 11, and the other end is rotationally connected to the base upper rod 21 of the base 2.

Because of the joint between the base 2 and the flipping support strip 4, the range of available adjustable positions of the elastic assembly 23 in the length direction of the base 2 is increased, so that the swinging range of the folding rocking chair frame can be adjusted by adjusting the position of the elastic assembly 23 in the length direction of the base 2. Moreover, the upper connection member 231 in the elastic assembly 23 is sleeved on the base upper rod 21, and the lower connection member 233 is sleeved on the base lower rod 22, so that not only the elastic assembly 23 will not slide out of the base 2, but also it facilitates the position adjustment of the elastic assembly 23 in the length direction of the base 2.

The connection portion 3 includes a set of first cross-connecting rods 31 and a set of second cross-connecting rods 32. Based on the orientation of the user sitting on the folding rocking chair, the face orientation is the front, and the back orientation is the back. The set of first cross-connecting rods 31 are connected to each of the side frames 10 toward the front of the seat body 1. Lower ends of the first cross-connecting rods 31 are rotationally connected to two hinge bases 5 respectively, and upper ends of the first cross-connecting rods 31 are rotationally connected to the support surface forming rods 13. The second cross-connecting rods 32 are connected to the side frames at the back side of the seat body 1. End of the second cross-connecting rods 32 are rotationally connected to joints between the reclining surface forming rods 11 and the support surface forming rods 13 at each side of the seat body 1 respectively. The other ends of the second cross-connecting rods 32 are rotationally connected to the reclining surface forming rods 11. While the drawings show a set of front cross-connecting rods 31 and a set of back cross-connecting rods 32, only one set of rods may be provided, or only one rod in one or more sets may be provided.

Figure 5:
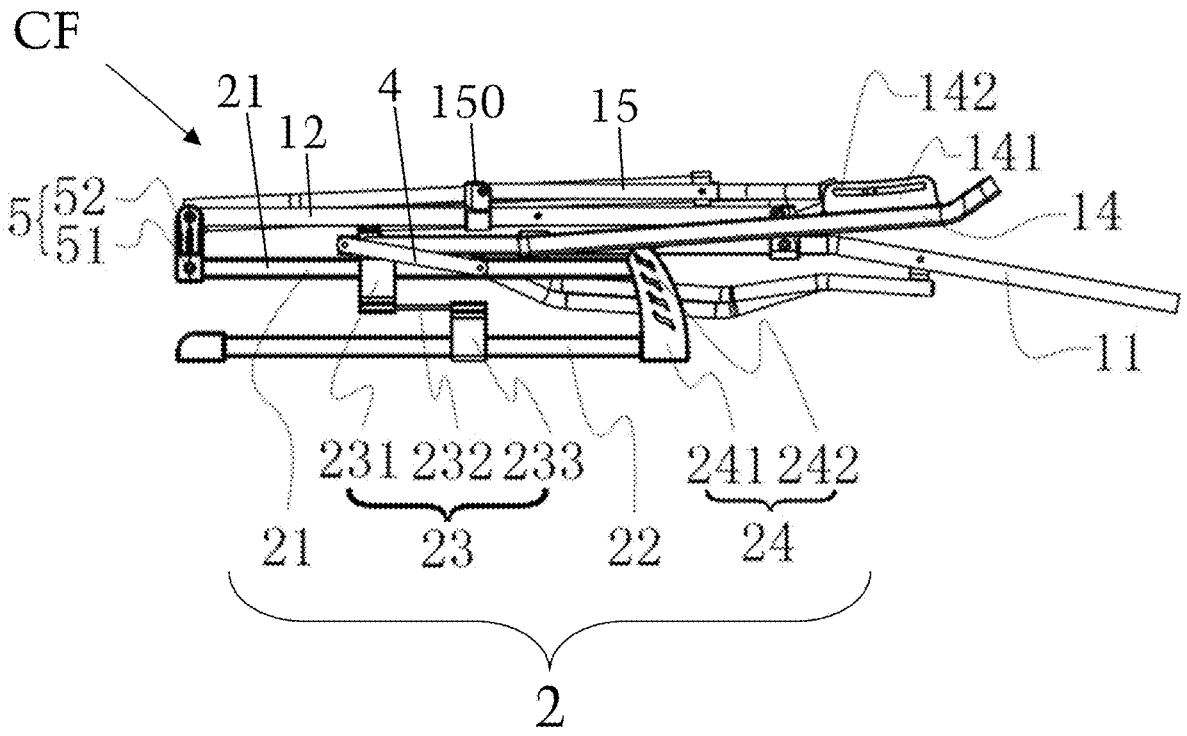
FIG. 5 is a side view of the folding rocking chair frame of FIG. 1 in a folded state.
Figure 6:
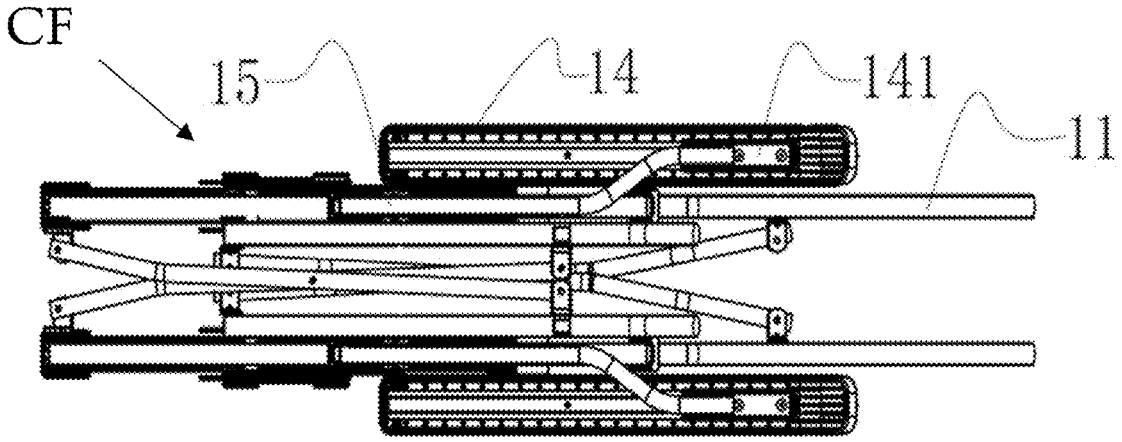
FIG. 6 is a bottom view of the folding rocking chair frame of FIG. 1 in a folded state.

The folding rocking chair frame has a folded state and an unfolded state. The unfolded state is best shown in FIG. 1 and FIG. 3, and the folded state is shown in FIG. 4 to FIG. 6.

Figure 3:
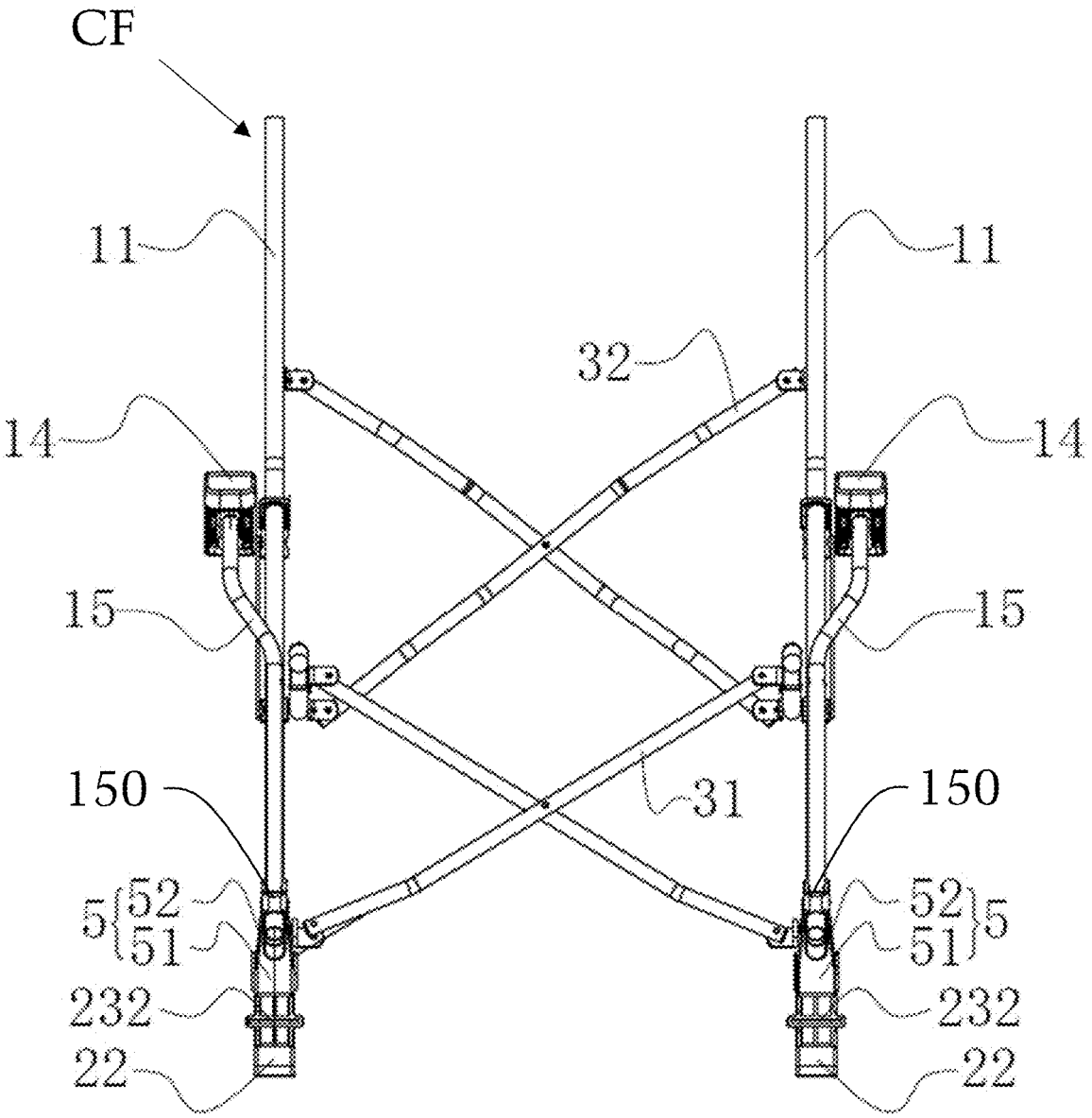
FIG. 3 is a front view of the folding rocking chair frame of FIG. 1.

When the folding rocking chair frame is at the unfolded state, as shown in FIG. 1 and FIG. 3, the connection portion 3 expands the two side frames 10 and the two bases 2 laterally and defines a mounting space of a seat surface between two side frames, i.e., the mounting space of the support surface of the seat body 1 is formed between two support surface forming rods 13, and the mounting space of the backrest surface of the seat body is formed between two reclining surface forming rods 11. In this position, the seat body 1 can rock on the bases 2 in an orientation of the seat body.

Figure 4:
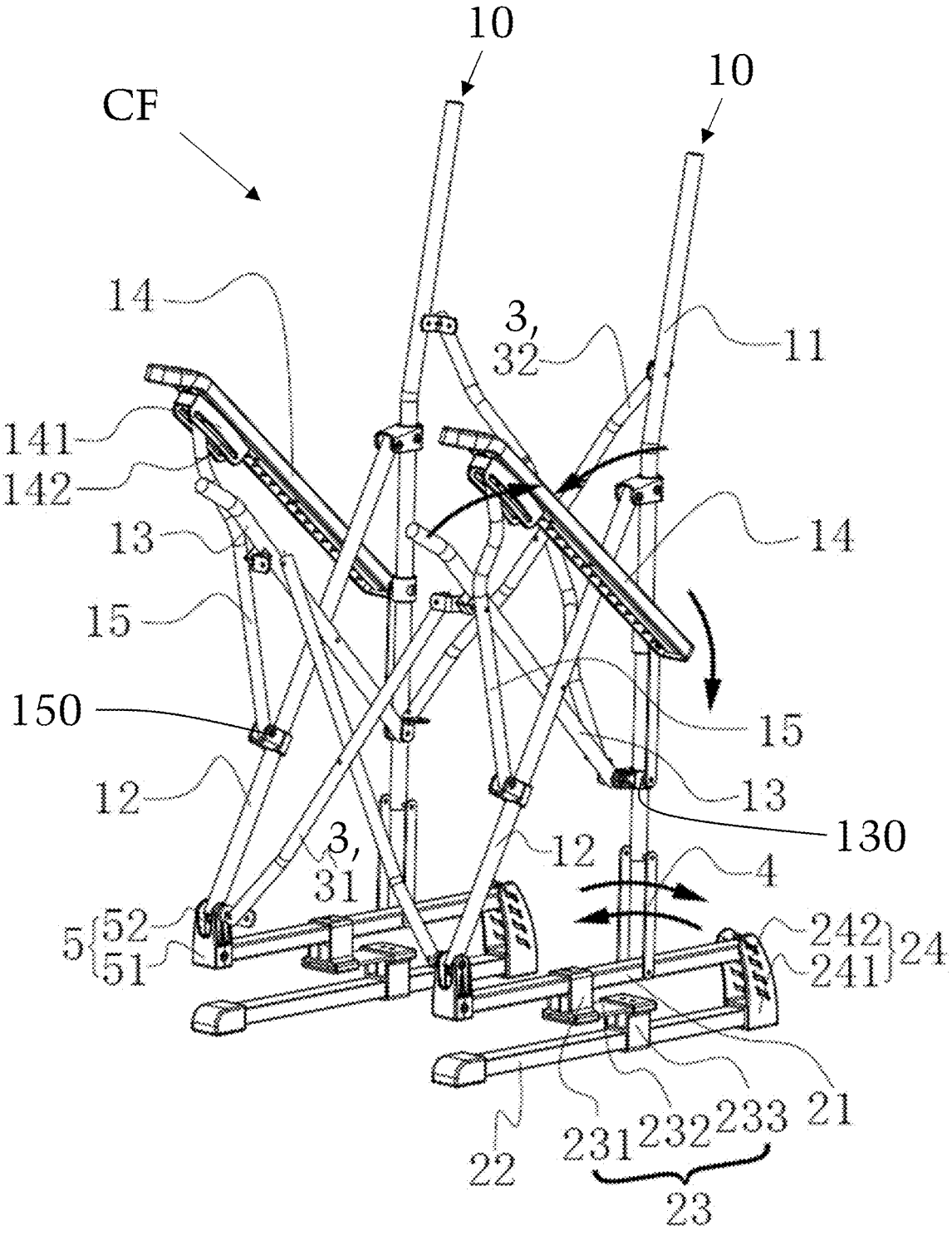
FIG. 4 is a perspective view of the folding rocking chair frame of FIG. 1 as it is being moved from the unfolded state to a folded state.

When the folding rocking chair frame is moved to the folded state, as shown in FIG. 4, the first cross-connecting rod 31 and the second cross-connecting rod 32 are moved such that the side frames 10 are move closer or adjacent to each other. At the same time, the reclining surface forming rod 11 is pulled upwardly, and the reclining surface forming rod 11 drives the flipping support strip 4 to rotate (counter-clockwise in FIG. 4), until the flipping support strip 4 is substantially perpendicular to the base 2 with the top end of the reclining surface forming rod 11 projecting rearwardly away from the base 2. At the same time, the front support rod 12 rotates (clockwise in FIG. 4) toward the rear of the base 2 and rests generally on top of the reclining surface forming rod 11. Accordingly, the rear slide connection member 130 between the support surface forming rod 13 and the reclining surface forming rod 11 slides downwardly along the reclining surface forming rod 11. The linkage support strip 16 is pulled downwardly and pulls the armrest member 14 to rotate in a direction close to the reclining surface forming rod 11. The armrest member 14 pulls the armrest member support rod 15 toward the armrest member 14 (clockwise in FIG. 4). The front slide connection member 150 of the armrest member support rod 15 slides upwardly along the front support rod 12. In the folded configuration, the distance between two side frames 10 is smaller than the distance between two side frames when the folding rocking chair frame is at the unfolded configuration. In the folded configuration, the distance between the pivoting joint of the flipping support strip with the reclining surface forming rod 11 along the base 2 and the joint of the front support rod 12 to the base 2 is smaller than the distance between them when the folding rocking chair frame is in the unfolded configuration. In the folded configuration, the armrest member 14, the base 2, and all rods may be folded together in a compact bundle to form a column, as shown in FIG. 5 and FIG. 6, with the reclining surface forming rod 11 substantially parallel to the base 2, the front support rod 12 and the armrest member support rod 15.

In the described embodiment, the reclining surface forming rod 11 and the base 2 are movably connected by the flipping support strip 4. When the folding rocking chair frame is unfolded, the reclining surface forming rod 11 can abut against the base 2 without sliding, which ensures the stability of the folding rocking chair frame. When the folding rocking chair is folded, the flipping support strip 4 creates necessary clearance between the base 2 and the reclining surface forming rod 11 to allow the base 2 and the reclining surface forming rod 11 to pivot adjacent one another as necessary. In the prior art, the stroke of sliding motion needed for the connection of the bottom of backrest with the base during folding limits the available location of the elastic assembly. In the disclosed embodiment, the movement of the flipping support strip 4 relative to the reclining surface forming rod 11 and the base 2 increases the adjustable range of positions of the elastic assembly 23, and the amount of rocking of the folding rocking chair frame may also be increased. Further, in the unfolded configuration, the flipping support strip 4 connection with the reclining surface forming rod 11 and the reclining surface forming rod 11 abutment with the base 2 provides more stability in comparison to the prior chair having the sliding connection of the bottom of backrest with the base.

Figure 7:
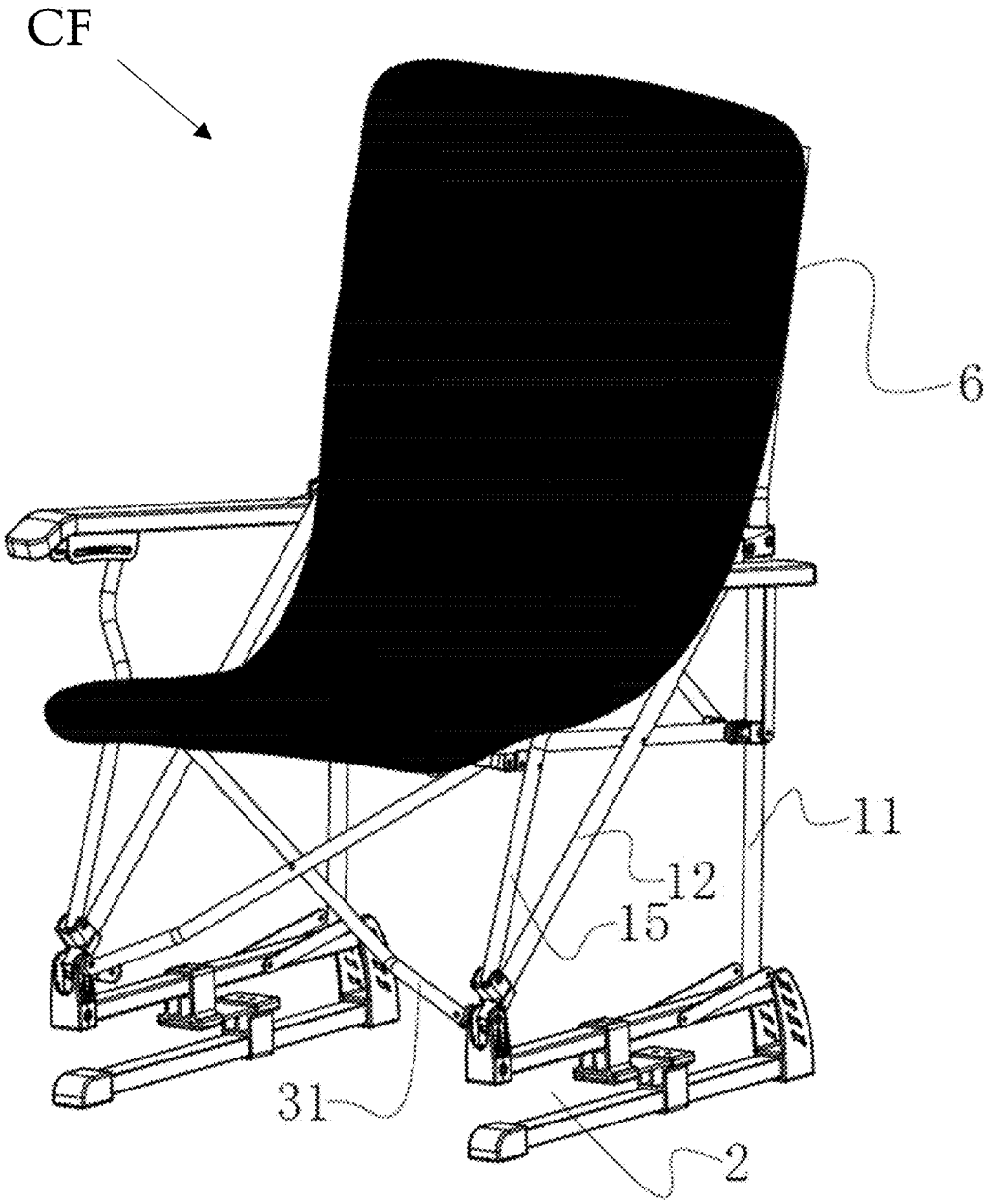
FIG. 7 is a perspective view of the folding rocking chair of FIG. 1.

Making reference to FIG. 7, a folding rocking chair includes a flexible seat surface 6 assembled with the folding rocking chair frame CF. The material of the flexible seat surface 6 can be nylon, canvas, polyester, etc., which is not limited herein. When the folding rocking chair frame is unfolded, the mounting space of the seat surface 6 is defined by the two side frames 10, and the flexible seat surface 6 is arranged in the mounting space to form the folding rocking chair.

Alternate Embodiment

In an alternate embodiment (not shown) to Embodiment 1, the bottom end of the reclining surface forming rod 11 may be hinged to the base upper rod 21 of the base 2, and the bottom end of the front support rod 12 may be operatively connected to the base upper rod 21 of the base 2 by the flipping support strip 4.

When the folding rocking chair frame is in the unfolded state, the seat body in the embodiment is consistent with the seat body in Embodiment 1 and will not be repeated herein. When the folding rocking chair frame is in the folded state, the action of the seat body is consistent with that of Embodiment 1. However, unlike Embodiment 1, in the alternate embodiment, the flipping support strip 4 is pulled upwardly by the front support rod 12 until the flipping support strip 4 is substantially perpendicular to the base 2. At this time, the base 2 is rotated in a direction close to the reclining surface forming rod 11 until the armrest member 14, the base 2, and all rods are folded together in a bundle to form a column, at which time the reclining surface-forming rod 11 is substantially parallel to the base 2.

Further Alternate Embodiment

Figure 8:
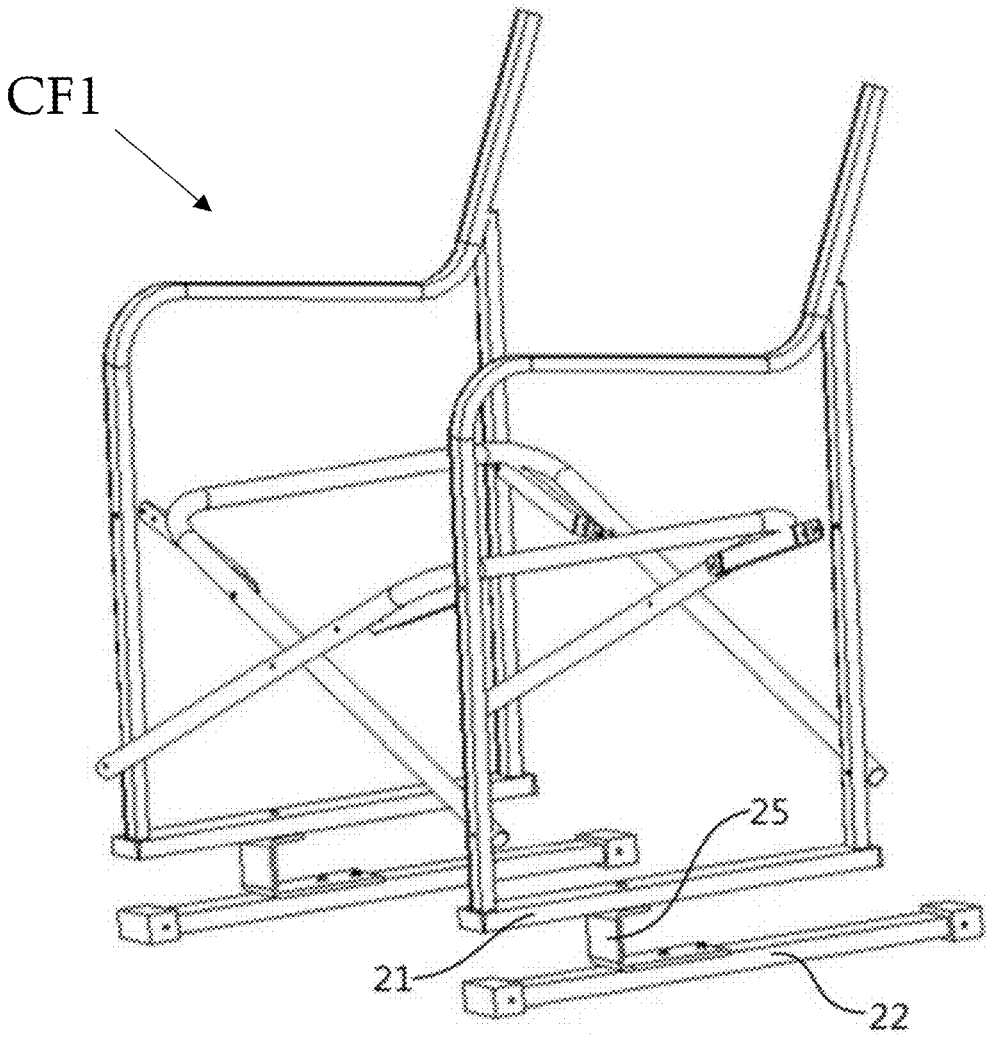
FIG. 8 is a perspective view of an alternate embodiment of a folding rocking chair in accordance with the present disclosure.
Figure 9:
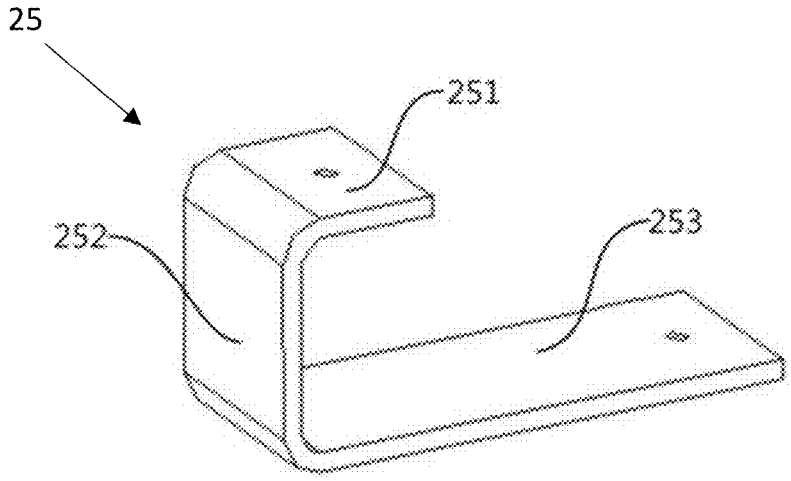
FIG. 9 is a perspective view of an elastic folding plate in the embodiment of the folding rocking chair of FIG. 8.

In a further alternate embodiment, the elastic assembly 23 may be replaced with an elastic folding plate 25. As shown in FIG. 8 and FIG. 9, the elastic folding plate 25 includes an upper mounting part 251, a connection part 252, and a lower mounting part 253. The upper mounting part 251, the connection part 252, and the lower mounting part 253 may be formed in a shape of C or Z in the side view direction. When the elastic folding plate is in the shape of C, the upper mounting part 251 and the lower mounting part 253 are oriented in the same direction as shown in FIG. 9, and when the elastic folding plate is in the shape of Z, the upper mounting part 251 and the lower mounting part 253 are oriented in opposite directions. The connection part 252 connects the upper mounting part 251 and the lower mounting part 253 and provides the elasticity to the base upper rod 21 and the base lower rod 22. The upper mounting part 251, the connection part 252, and the lower mounting part 253 can be individual parts welded together or more preferably or integrally molded or monolithically formed. The upper mounting part 251 is fixedly connected to the base upper rod 21, and the lower mounting part 253 is fixedly connected to the base lower rod 22. The specific connection method can be a threaded connection, riveting, welding, etc., which is not limited herein.

The above is only the specific embodiments of the present disclosure, but the protection scope of the present disclosure is not limited thereto. The technical person familiar with the field should understand that the present disclosure includes but is not limited to the contents described in the drawings and the specific embodiments above. Any modification that does not deviate from the functional and structural principles of the present disclosure will be included in the scope of the claims.

The invention claimed is:

1. A folding rocking chair having a frame structure, the frame structure being movable between a folded state and an unfolded state, the frame structure comprising a seat body and first and second bases to support the seat body on a support surface, the seat body comprising first and second side frames, the first and second side frames being connected with the corresponding first and second bases, the first and second side frames being connected together with a connection portion, each side frame comprising a reclining surface forming rod and a front support rod, each of the reclining surface forming rods having a base end and an opposite upper end, each of the front support rods having a base end and an opposite upper end;

wherein on each side frame, the upper end of the front support rod is operatively hingedly connected to the reclining surface forming rod, one of the base end of the front support rod and the base end of the reclining surface forming rod is hingedly connected to the respective base and the other of the base end of the front support rod and the base end of the reclining surface forming rod is swingingly connected to the respective base with a flipping support strip;

wherein each of the flipping support strips has one end rotationally connected to the respective other of the base ends of the reclining surface forming rods and the base ends of the front support rods, and another end rotationally connected to the respective bases;

wherein when the frame structure is in the unfolded state, the connection portion is configured to position the first and second side frames away from each other so as to define a mounting space of a seat surface between the first and second side frames such that the seat body can rock on the first and second bases in forward and backward directions relative to an orientation of the seat body on the first and second bases;

wherein when the frame structure is in the folded state, the connection portion is configured to position the first and second side frames away from each other at a distance less than a distance between the first and second side frames when the frame structure is in the unfolded state; and wherein when the frame structure is in the folded state, each of the flipping support strips is rotatable relative to the respective bases in a manner such that the other of the base end of the reclining surface forming rod and the base end of the front support rod is at a first distance from the hinged connection of the one of the base end of the reclining surface forming rod and the base end of the front support rod along the respective base; and wherein when the frame structure is in the unfolded state, each of the flipping support strips is rotatable relative to the respective bases in a manner such that the other of the base end of the reclining surface forming rod and the base end of the front support rod is at a second distance from the hinged connection of the one the base end of the reclining surface forming rod and the base end of the front support rod along the respective base, the first distance being less than the second distance.

2. The folding rocking chair according to claim 1, wherein each of the bases comprises a base upper rod, a base lower rod and an elastic assembly, the base upper rods and the base lower rods are connected together by the respective elastic assemblies, the other of the base ends of the reclining surface forming rods and the base ends of the front support rods are rotationally connected to the respective base upper rods by the respective flipping support strips.

3. The folding rocking chair according to claim 2, wherein each of the elastic assemblies comprises an upper connection member, an elastic plate, and a lower connection member, the upper connection members are connected to one end of the respective elastic plates, the lower connection members are connected to an opposite end of the respective elastic plates, the lower connection members are sleeved on the base lower rods; and the upper connection members are sleeved on the base upper rods.

4. The folding rocking chair according to claim 2, wherein each of the elastic assemblies comprises an upper mounting part, a lower mounting part, and a connection part extending between the upper mounting part and the lower mounting part, the upper mounting parts are connected to the base upper rods, and the lower mounting parts are connected to the base lower rods.

5. The folding rocking chair according to claim 4, wherein each of the elastic assemblies has a shape in side view comprising one of C-shape and a Z-shape.

6. The folding rocking chair according to claim 4, wherein for each base, the upper mounting part, the lower mounting part, and the connection part are monolithically formed.

7. The folding rocking chair according to claim 2, wherein each base further comprises an anti-trap foot pad, each anti-trap foot pad comprises a foot mounting part with side plates extending outward from the foot mounting part, the foot mounting part is mounted on the base lower rod, the side plates are spaced apart sufficiently to accommodate the base upper rod disposed between the side plates.

8. The folding rocking chair according to claim 7, wherein each anti-trap foot pad is arranged on at least one end of each of the respective bases.

9. The folding rocking chair according to claim 1, wherein for each base, the one of the base end of the reclining surface forming rod and the base end of the front support rod is hingedly connected to the base by a hinge base, the hinge base comprises a mounting portion and hinge side portions extending outward from the mounting portion, the mounting portion is mounted to the base, the hinge side portions are spaced apart in a manner so as to accommodate a connection with the one of the base end of the reclining surface forming rod and the base end of the front support rod.

10. The folding rocking chair according to claim 1, wherein each side frame comprises a support surface forming rod such that when the frame structure is in the unfolded state, a mounting space of for the seat body is formed between the two support surface forming rods, on each frame, one end of the support surface forming rod is slidably connected to the reclining surface forming rod and the support surface forming rod is pivotally connected to the front support rod.

11. The folding rocking chair according to claim 10, wherein the connection portion comprises a set of two first cross-connecting rods, lower ends of the first cross-connecting rods are rotationally connected to the respective bases, upper ends of the first cross-connecting rods are rotationally connected to the respective support surface forming rods.

12. The folding rocking chair according to claim 11, wherein the connection portion further comprises a set of two second cross-connecting rods, lower ends of the second cross-connecting rods are rotationally connected to connectors connecting the respective reclining surface forming rods to the support surface forming rods, upper end of the second cross-connecting rods are rotationally connected to the respective reclining surface forming rods.

13. The folding rocking chair according to claim 12, wherein each side frame comprises an armrest member and a linkage support strip, for each side frame, one end of the linkage support strip is rotationally connected to the connector connecting the reclining surface forming rod to the support surface forming rod, an opposite end of the linkage support strip is rotationally connected to a back end of the armrest member.

14. The folding rocking chair according to claim 13, wherein each side frame comprises an armrest member support rod, for each side frame, one end of the armrest member support rod is rotationally connected to the armrest member, an opposite end of the armrest member support rod is slidably connected to the front support rod.

15. The folding rocking chair according to claim 14, wherein each armrest member is provided with a connection part, for each armrest member, the connection part is provided with a sliding groove, the armrest member support rod is rotationally connected to the armrest member via the sliding groove.

16. The folding rocking chair according to claim 14, wherein for each side frame, the support surface forming rod is rotationally connected to the armrest member support rod.

17. The folding rocking chair according to claim 10 wherein for each side frame, the support surface forming rod is rotationally connected to the front support rod.

* * * * *